US005423542A

United States Patent [19]

Oraha

[11] Patent Number: 5,423,542

[45] Date of Patent: Jun. 13, 1995

[54] RANDOM INDICIA SELECTOR

[76] Inventor: Youbert Oraha, 2435 Kipling Avenue, Apt. 1103, Rexdale, Ontario, Canada, M9V 3A7

[21] Appl. No.: 119,616

[22] Filed: Sep. 13, 1993

[51] Int. Cl.[6] ..... A63F 3/06

[52] U.S. Cl. ..... 273/144 B; 273/144 R

[58] Field of Search ..... 273/144 B, 144 R, 144 A, 273/145 C

[56] References Cited

U.S. PATENT DOCUMENTS

| | | | |
|---|---|---|---|
| 2,103,151 | 12/1937 | Dietrich | 273/144 B |
| 4,403,775 | 9/1983 | Chaput | 273/144 B |
| 4,509,755 | 4/1985 | Cheatham | 273/144 B |
| 4,699,382 | 10/1987 | Kabana | 273/144 B |
| 4,796,890 | 1/1989 | Snyder | 273/144 B |
| 4,895,370 | 1/1990 | Kline | 273/144 B |

*Primary Examiner*—Benjamin H. Layno

[57] ABSTRACT

A small hand held apparatus for randomly selecting at least several indicia comprises a small enclosed container having a main chamber and a number of pockets that open into this chamber. A plurality of balls are located in the container with the number thereof substantially exceeding the number of pockets. The pockets are sized to permit only one of the balls to fit into any one pocket at any time. The selected indicia is marked on each ball at several locations thereon so as to enable the indicia to be viewed when the respective ball has entered one of the pockets which are made of transparent material. Preferably all of the container is transparent so that all of the balls therein can be viewed.

12 Claims, 2 Drawing Sheets

RANDOM INDICIA SELECTOR

BACKGROUND OF THE INVENTION

This invention relates to apparatus for randomly selecting at least several indicia, for example numbers.

In recent years lotteries of various sorts have become very popular in North America and elsewhere with many of these lotteries being operated by state and provincial governments. A number of these lotteries are based on the need for a player to correctly select at least several numbers out of a much larger group of possible numbers. It will be appreciated that the chances of selecting the proper numbers in a lottery of this type can be very high indeed but such lotteries are popular because of the possibility of winning a large sum of money. For example, in one such lottery it is necessary to select each of six numbers correctly out of a possible 49 numbers running from 1 to 49.

Devices for randomly selecting lottery numbers for a particular lottery game are known in the art. For example, U.S. Pat. No. 4,403,775 which issued Sep. 13, 1983 to J. R. Chaput describes a random indicia selector which is quite small and suitable for carrying on a key chain or the like. This known device includes a housing containing a large number of balls that are of two different colours. At least the front of the housing is made of a transparent plastic so that the contents of the housing ie. the balls, can be viewed. The housing forms a compartment with an upper, larger section and a smaller, bottom section that is divided into several channels, for example, four channels. Marked on the transparent cover over these channels are rows of indicia, the total number of indicia corresponding to the number of balls. The majority of balls are coloured in the same manner as the indicia but a number of balls are of a different colour. The indicia that are located in front of the balls that are of a contrasting colour will stand out in this apparatus and, on this basis, they can be selected by the user for purposes of a lottery game.

The present invention provides a simple and inexpensive apparatus that can be used by lottery players to randomly select at least several indicia such as numbers. Moreover, the invention can take the form of different versions with different numbers of balls and pockets for receiving same in order that apparatus suitable for a number of different lottery games may be provided.

SUMMARY OF THE INVENTION

According to one aspect of the invention, an apparatus for randomly selecting at least several indicia comprises a small enclosed container having a main chamber and at least several pockets that open into said main chamber and that have closed bottom ends. The container and the pockets are made of transparent material permitting the contents thereof to be viewed. The container has a cylindrical central section and two hemispherical end portions with the pockets being formed within the cylindrical central section on one side thereof. A plurality of balls are located in the container with the number of balls substantially exceeding the number of pockets. The pockets and balls are sized to permit only one of the balls to fit into any one of the pockets at any time. A selected indicia is marked on each ball at at least several locations thereon so as to enable the selected indicia to be viewed when the respective ball has entered one of the pockets whatever the orientation of the respective ball in the pocket may be.

In the preferred version all of the container is made of transparent plastics material permitting the contents thereof to be viewed.

According to another aspect of the invention, an apparatus for randomly selecting at least five indicia comprises an enclosed transparent container having a single main chamber and at least five pockets that open into the main chamber. There are also at least 40 balls of the same size located in the container. The pockets are sized to permit only one of the balls to fit into any one of the pockets at any time. Each ball has marked thereon at several locations a selected indicia which is different from the indicia on any other ball in the container. Whenever a particular ball falls into any of the pockets, the indicia thereon can be viewed.

Preferably the selected indicia is marked on each ball at six locations distributed over the surface of the ball. The preferred container is small having a length not exceeding 3 inches so that it can be easily carried.

Further features and advantages will become apparent from the following detailed description taken in conjunction with the accompanying drawings.

DETAILED DESCRIPTION OF PREFERRED EMBODIMENTS

Figure 1:
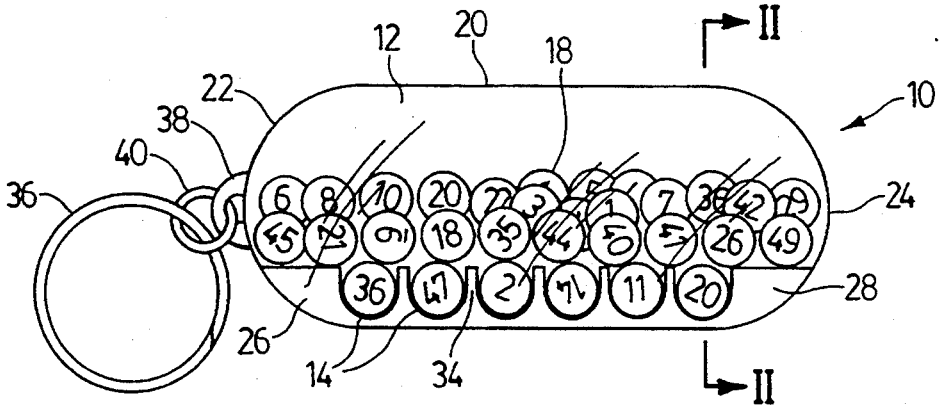
FIG. 1 is a side view of a first embodiment of an apparatus for randomly selecting a number of indicia constructed in accordance with the invention.
Figure 2:
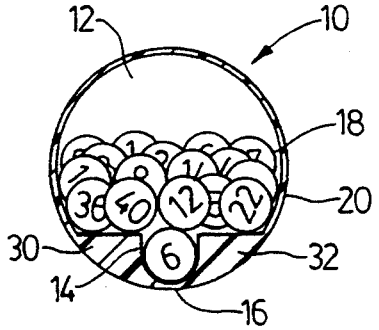
FIG. 2 is a cross-sectional view of the embodiment of FIG. 1 taken along the line II—II of FIG. 1.

FIGS. 1 and 2 illustrate a first version of a small apparatus for randomly selecting at least several indicia which typically would be numbers. The apparatus comprises a small enclosed container 10 having a main chamber 12 and at least several pockets 14 that open into the main chamber. Each pocket has a closed bottom end 160 In the illustrated device, there are six of these pockets arranged side-by-side in a straight line alone one side of the main chamber 12. At least the pockets 14 are made of transparent material permitting the contents thereof to be viewed. Preferably, the entire container is made of this transparent material so that the entire contents of the container can be viewed readily.

A plurality of balls 18, preferably of exactly the same size, are located in the container and the number of balls substantially exceeds the number of pockets 14. For example, in one version of this device there are six pockets 14 and 49 balls, making this device particularly suitable for a known lottery wherein it is necessary to pick six correct numbers out of the range of numbers extending from 1 to 49. The balls 18 and the pockets 14 are sized to permit only one of the balls to fit into any one of the pockets at any time as shown in FIG. 1.

In the version of FIGS. 1 and 2, the container 10 has a cylindrical central section 20 that extends most of the length of the container and also two hemispherical end portions 22 and 24. The pockets 14 are formed within the cylindrical central section on one side thereof. In order to form the pockets, there are end regions 26 and 28 formed at opposite ends of the container and which form part of the pockets 14 at each end of the row. There are also relatively thick, longitudinally extending wall sections 30 and 32 formed on opposite sides of the row of pockets 14 which further define and enclose the pockets. These wall sections are located within the cylindrical central section and the hemispherical end portions. Located between adjacent pairs of pockets 14 is a short dividing wall 34, which each wall 34 extending between the wall sections 30 and 32.

The preferred container 10 has a key ring 36 connected to the container at one end thereof. In the preferred version shown, there is an integral plastic connecting loop 38 formed on or attached to one end of the container 10 and a small metal or plastic ring 40 can be used to attach this loop to the key ring 36. In this way the device of the invention can be carried with one's keys so that it is readily available to perform the operation of randomly selecting numbers for a lottery game.

Figure 9:
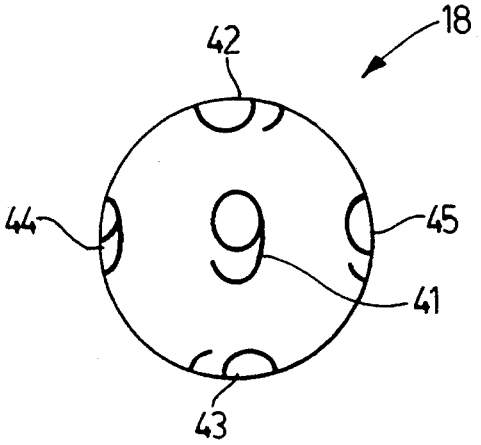
FIG. 9 illustrates one of the balls that can be placed in the container and the indicia marked thereon.

FIG. 9 of the drawings illustrates the preferred indicia marking on a ball 18. The selected indicia, in this case the number 9, is marked on each ball at at least several locations thereon so as to enable the selected indicia to be viewed when the respective ball has entered one of the pockets 14 whatever the orientation of the respective ball in the pocket may be. Preferably the selected indicia is marked on each ball at at least four locations distributed over the surface of the ball. Most preferably the selected indicia is marked on each ball at six locations distributed over the surface of the ball. Five of the six locations are indicated at 41 to 45 on FIG. 9 and these include the front location 41, a top location 42, a bottom location 43 and the left and right sides of the ball at 44 and 45. The indicia would also be marked on the rear surface of the ball 18 (not shown in FIG. 9). The balls can range in size but preferably have a diameter in the range of 6 mm to 7 mm. The indicia placed on the sides of the ball should be be large enough to permit the indicia to be easily read from outside of the clear plastic container.

Figure 4:
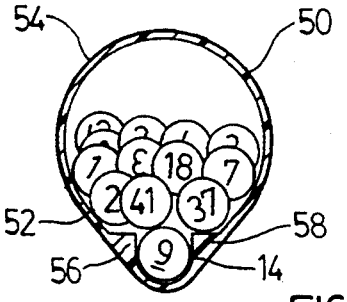
FIG. 4 is a transverse cross-sectional view of the embodiment of FIG. 3 taken along the line IV—IV of FIG. 3.
Figure 3:
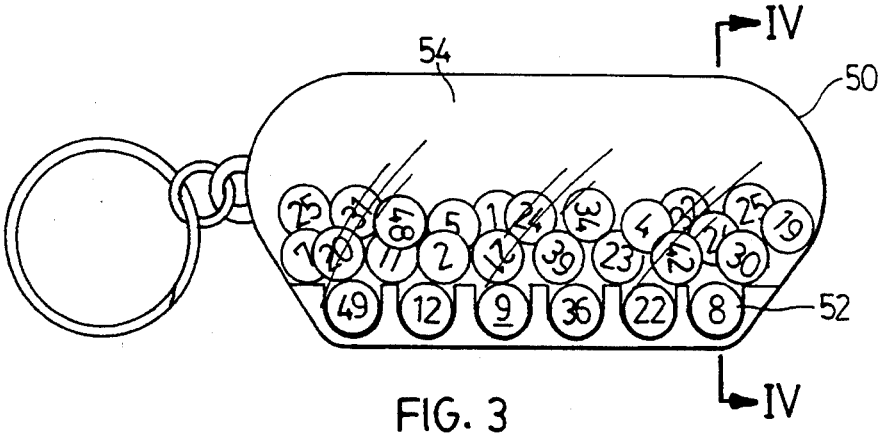
FIG. 3 is a side view of a second embodiment of the invention.

A second embodiment of the invention is illustrated in FIGS. 3 and 4 of the drawings. In this embodiment, the container 50 is elongate and in transverse cross-section has a substantially V-shaped bottom portion 52 and a semi-circular top portion 54. Again the pockets 14 are arranged in a single longitudinal row, which row is located in the V-shaped bottom portion. The pockets are defined on each side by two, relatively thick, longitudinally extending wall sections 56 and 58 which form shoulders where the main chamber meets the pockets. Aside from the different shape of the container 50, it is otherwise similar in its construction to the container 10 of the first embodiment.

Figure 5:
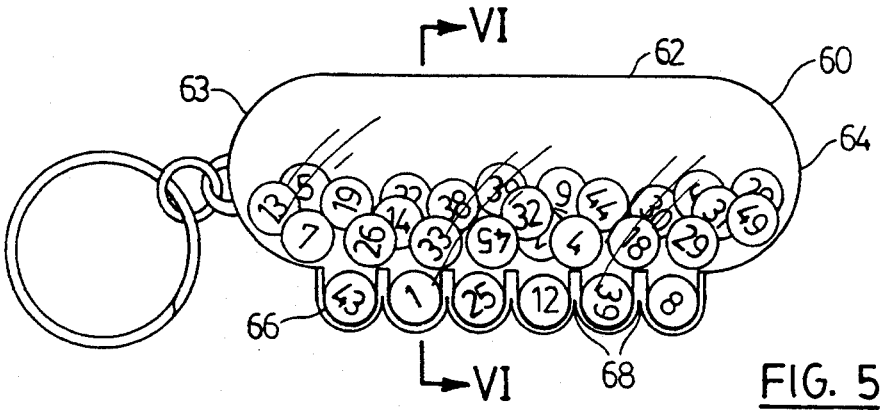
FIG. 5 is a side view of a third embodiment of the invention wherein the pockets project from the side of the cylindrical main body of the container.
Figure 6:
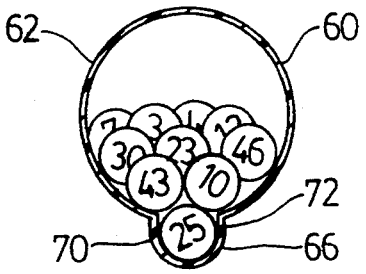
FIG. 6 is a transverse cross-sectional view of the embodiment of FIG. 5 taken along the line VI—VI of FIG. 5.

A third embodiment of the invention is illustrated in FIGS. 5 and 6 of the drawings. In this embodiment the container 60, like the first embodiment, has a cylindrical central section 62 and two hemispherical end portions 63 and 64. However, unlike the first embodiment, in the third embodiment the pockets 66 project from one side of the cylindrical central section forming rounded bulges along one side. Again, the pockets are arranged side-by-side in a single row. Adjacent pockets 66 are separated from one another by a common internal wall 68. The pockets are formed with their own sidewalls 70 and 72 indicated in FIG. 6.

Figure 7:
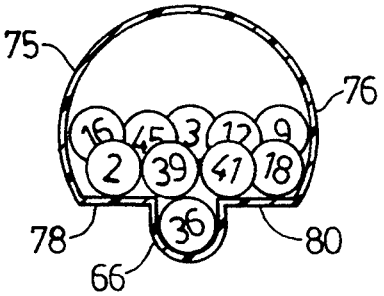
FIG. 7 is a transverse cross-section of a fourth possible embodiment of the invention.
Figure 8:
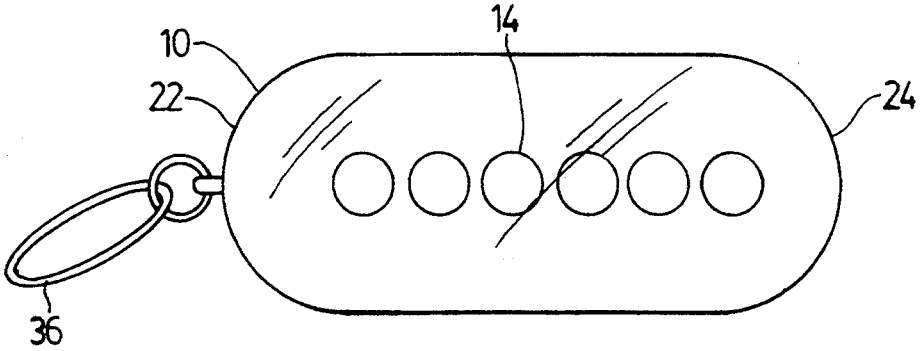
FIG. 8 is a bottom view of the embodiment of FIG. 1, which view does not show the balls in the container for ease of illustration.

FIG. 7 illustrates a minor variant from the container construction of FIG. 1. In this embodiment, the container 75 has a central section which is a partial cylinder indicated at 76. Connecting the tops of the pockets 66 to the partial cylindrical wall are flat connecting webs 78 and 80. It will be understood that the pockets 66 in this version are constructed in the same manner as those in the third embodiment shown in FIGS. 5 and 6.

In one preferred embodiment of the invention the enclosed container has a length of about 65 mm. In this version which has a cylindrical central section, the diameter of this section is about 26 mm and the depth of the pockets 14 is 6 mm. It will thus be appreciated that the preferred version of the container is small, having a length not exceeding about 3 inches.

Operation of the device will be readily apparent. The container is simply arranged so that all of the balls are located outside of the pockets. This is accomplished by arranging the container so that the pockets are on the top. The container is then shaken so as to randomly arrange the balls in the container and then the container is turned so that an individual ball falls into each of the pockets provided. Since all of the balls are differently numbered, the result is a random selection of at least several different numbers, these being the numbers shown on the balls in the pockets.

If desired, the balls can be made of different colours and this can aid in the proper reading of the indicia on the ball. Thus, the balls can, for example, be separated into groups of 10 balls with each group having its own colour. In the case of a container containing 49 balls, for example, the balls numbered 1 to 10 could be coloured red, the balls numbered 11 to 20 could be coloured green, the balls numbered 21 to 30 could be coloured black, the balls numbered 31 to 40 could be coloured blue and the remaining nine balls could be coloured yellow. Colour selection could be made on the basis of consumer preference, for example, by choosing colours that have eye appeal.

The container 10 or 50 can be made from a variety of suitable plastics. Some preferred plastics for this purpose are high impact injection molded lucite or polycarbonate. The container can be made from an injection molding process. The balls can be made from polyethylene, polystyrene or polycarbonate and the numbers can be stamped or stencilled on the balls.

As indicated, the number of actual balls in the container can vary with the actual number depending to some extent on the particular lottery game that the device has been constructed for. However, for most lottery games there would be at least five pockets extending along one side of the main chamber and at least 40 balls located in the container.

It will be understood that various modifications and changes can be made to the apparatus of the invention without departing from the spirit and scope of this invention. Accordingly, all such modifications and changes as fall within the scope of the appended claims are intended to be part of this invention.

I claim:

1. Apparatus for randomly selecting at least several indicia comprising a small enclosed container having a main chamber and at least several pockets that open into said main chamber and that have closed bottom ends, said container and said pockets being made of transparent material permitting the contents thereof to be viewed, said container having a cylindrical central section and two hemispherical end portions with said pockets being formed within said cylindrical central section on one side thereof and arranged side-by-side in a single row, said pockets being formed by relatively thick, longitudinally extending wall sections disposed on opposite sides of said pockets, which wall sections are located within said cylindrical central section and hemispherical end portions; and a plurality of balls located in said container, the number of balls substantially exceeding the number of said pockets, said pockets and balls being sized to permit only one of said balls to fit into any one of said pockets at any time, wherein a selected indicia is marked on each ball at at least several locations thereon so as to enable the selected indicia to be viewed when the respective ball has entered one of said pockets whatever the orientation of said respective ball in said pocket may be.

2. Apparatus according to claim 1 wherein all of said container is made of transparent plastics material.

3. Apparatus according to claim 2 wherein said selected indicia is marked on each ball at at least four locations distributed over the surface of the ball and the indicia on each ball differs from the indicia on all of the other balls.

4. Apparatus according to claim 2 wherein a key ring is connected to said container at one end thereof.

5. Apparatus according to claim 1 wherein there are at least six pockets and at least thirty balls.

6. Apparatus according to claim 1 wherein there are at least 40 balls in said container and the balls are separable into groups of ten balls with each group having its own colour.

7. Apparatus for randomly selecting at least several indicia comprising a small enclosed container having a main chamber and at least several pockets that open into said main chamber and that have closed bottom ends, said container and said pockets being made of transparent material permitting the contents thereof to be viewed; said container being elongate and in transverse cross-section having a substantially V-shaped bottom portion and a semicircular top portion, said container also having two rounded end portions, said pockets being arranged in a single longitudinal row in the V-shaped bottom portion, said pockets being formed by relatively thick, longitudinally extending wall sections disposed on opposite sides of said pockets, which wall sections are generally within said V-shaped bottom portion, and a plurality of balls located in said container, the number of balls substantially exceeding the number of said pockets, said pockets and balls being sized to permit only one of said balls to fit into any one of said pockets at any time, wherein a selected indicia is marked on each ball at at least several locations thereon so as to enable the selected indicia to be viewed when the respective ball has entered one of said pockets whatever the orientation of said respective ball in said pocket may be.

8. Apparatus for randomly selecting at least five indicia comprising an enclosed transparent container having a single main chamber and at least five pockets that open into said main chamber, said container having a cylindrical central section and two hemispherical end portions with said pockets being formed within said cylindrical central section on one side thereof and arranged side-by-side in a single row, said pockets being formed by relatively thick, longitudinally extending wall sections disposed on opposite sides of said pockets, which wall sections are located within said cylindrical central section and hemispherical end portions, and at least forty balls of the same size located in said container, said balls including at least four groups of ten balls with each group having its own color, said pockets being sized to permit only one of said balls to fit into any one of said pockets at any time, wherein each ball has marked thereon at several locations a selected indicia which is different from the indicia on any other ball in said container, and whenever a particular ball falls into any of said pockets, the indicia thereon can be viewed.

9. Apparatus according to claim 8 wherein said selected indicia is marked on each ball at six locations distributed over the surface of the ball.

10. Apparatus according to claim 8 wherein said container is small having a length not exceeding three inches.

11. Apparatus according to claim 10 including a connecting loop attached to one end of said container.

12. Apparatus according to claim 8 wherein said selected indicia on each ball is a number.

* * * * *